United States Patent [19]

Kitagawa et al.

[11] 4,421,584

[45] Dec. 20, 1983

[54] PROCESS FOR THE PRODUCTION OF SHEET-LIKE MATERIAL COMPRISING SPLIT FIBERS AND APPARATUS THEREFOR

[75] Inventors: Hiroshi Kitagawa; Masaaki Sato, both of Nagoya; Shoji Shuto, Oita, all of Japan

[73] Assignee: Mitsubishi Rayon Co., Ltd., Tokyo, Japan

[21] Appl. No.: 368,233

[22] Filed: Apr. 13, 1982

[30] Foreign Application Priority Data

Apr. 13, 1981 [JP] Japan ..... 56-55207
Apr. 15, 1981 [JP] Japan ..... 56-56437

[51] Int. Cl.[3] ..... D01D 11/02

[52] U.S. Cl. ..... 156/178; 28/283; 156/181; 156/436

[58] Field of Search ..... 156/178, 181, 167, 324, 156/436; 28/283, 103; 18/299, 66 T, 66 R; 68/43; 8/151, 151.2; 264/DIG. 47, 146, 147

[56] References Cited

U.S. PATENT DOCUMENTS 3,376,609 4/1968 Kalwaites ..... 28/283
3,443,284 5/1969 Kalwaites et al. ..... 28/283
3,873,389 3/1975 Daniels ..... 28/283

FOREIGN PATENT DOCUMENTS 1387566 3/1972 United Kingdom ..... 28/283

*Primary Examiner*—Michael W. Ball
*Attorney, Agent, or Firm*—Sughrue, Mion, Zinn, Macpeak and Seas

[57] ABSTRACT

A process for producing a sheet-like material of split fibers, and an apparatus therefor are described. The process includes the steps of introducing a plurality of continuous fiber bundles into a liquid contained in an inclined splitting unit which is gradually widened toward the lower end thereof, the unit being divided into a plurality of grooves so that each fiber bundle travels in the liquid flowing in the corresponding groove, splitting each fiber bundle by the action of the liquid flowing in the groove while gradually widening the flow toward the lower end of the groove, uniformly arranging the resulting split fibers in a subsequent inclined splitting frame, and continuously placing the thus arranged split fibers on a rotating conveyor to form the sheet-like material.

16 Claims, 11 Drawing Figures

PROCESS FOR THE PRODUCTION OF SHEET-LIKE MATERIAL COMPRISING SPLIT FIBERS AND APPARATUS THEREFOR

BACKGROUND OF THE INVENTION

The present invention relates to a process for processing continuous fibers into finer continuous fibers (this process is called "splitting" herein, and the finer continuous fibers are called "split fibers") and arranging them to form a sheet-like material, and an apparatus for the production of such sheet-like material comprising the split fibers.

Methods for finely splitting continuous fibers have heretofore been extensively studied. Fiber-splitting methods for synthetic fibers produced by the molten spinning process which are well known in the art include methods in which static electricity is applied and splitting is achieved by the action of the electrical repulsion force, and in which splitting is achieved by blowing an air stream onto the continuous fibers. These methods are now in widespread use.

If carbon fibers could be effectively split, one would be able to easily produce a sheet-like material in which split fibers are properly arranged in one direction. It is, however, very difficult to split continuous carbon fibers by the conventional methods described above since the carbon fibers are readily damaged by only slight friction, unlike other synthetic fibers, resulting in the formation of fluff; and since they are electrically conductive.

Since carbon fibers exhibit good affinity with liquids such as water and alcohols, if fiber-splitting could be conducted by the utilization of such liquids, a very useful method would result.

A method of splitting continuous fibers and forming a sheet-like material by the utilization of a liquid stream, e.g., water, is known, as described in, for example, Japanese Patent Application (OPI) No. 121568/75, in which the equipment illustrated in FIG. 1 is used.

Referring to FIG. 1, a plurality of continuous fiber bundles 18 are introduced into a liquid tank 1 at a fixed rate by means of a pair of feed rollers 19 and, thereafter, are introduced into a liquid stream through a slit-like exit 5 by a suction action and fed to an inclined splitting unit 8, where the fibers are split in the lengthwise direction. In this method, however, the liquid stream in the inclined splitting unit 8 can freely extend its width toward the lower end of the unit 8 and, therefore, a plurality of continuous fiber bundles fed as a combined material of monofilaments partially overlap one another. This partial overlapping causes a difference in resistance in the width direction of the liquid diffusion-flowing in the inclined splitting unit 8, thereby producing an unevenness in the arrangement of the split fibers. Thus there can be obtained only an uneven sheet-like material as illustrated in FIG. 2, in which the split fibers are not uniformly arranged or disposed in the width direction of the sheet-like material. Furthermore, the twist that the continuous fiber bundle per se possesses makes it impossible to achieve splitting according to the above method. The reasons for this are that (1) it is difficult to stabilize the liquid stream containing intertwisted or twisted fiber bundles, and (2) in feeding the continuous fiber bundles to the liquid stream, air is entrained in the liquid stream, making it impossible to achieve uniform splitting continuously.

SUMMARY OF THE INVENTION

The object of the invention is to provide: (a) a process for continuously producing a sheet-like material comprising split fibers which is free from the above described defects and has great uniformity, and (b) an apparatus for the production of such sheet-like material.

The present invention, therefore, relates to a process for producing a sheet-like material comprising split fibers which includes introducing a plurality of continuous fiber bundles into a liquid contained in an inclined splitting unit which is gradually increased in width toward the lower end thereof, the unit being divided into a plurality of rooms or grooves so that each bundle travels in the liquid flowing in the corresponding groove, splitting each fiber bundle by the action of the liquid flowing in the groove while gradually increasing the flow width toward the lower end of the groove, uniformly arranging the resulting split fibers in a subsequent unit, and then, continuously placing the thus arranged split fibers on a rotating bored conveyor to form the sheet-like material; and an apparatus for the production of a sheet-like material comprising split fibers which includes:

a liquid tank from which a plurality of continuous fiber bundles are fed through a slit-like flow exit provided at the lower portion of the side wall of the liquid tank together with the liquid;

an inclined splitting unit which is gradually increased in width toward the lower end thereof, the unit being divided by a plurality of rooms or grooves which are inclined and increased in width toward the lower end of the unit, and the top plate and/or bottom plate constituting the groove being provided with a plurality of projections in a direction perpendicular to the flow-direction of the liquid; and a subsequent inclined splitting unit which is gradually increased in width toward the lower end thereof, this unit being provided with a plurality of projections at the bottom plate thereof in a direction perpendicular to the flow direction of the liquid.

DETAILED DESCRIPTION OF THE PREFERRED EMBODIMENTS

The invention will hereinafter be explained in detail with reference to the accompanying drawings. For the sake of convenience, an embodiment is explained in which six continuous fiber bundles are split to prepare a sheet-like material.

Figure 1:
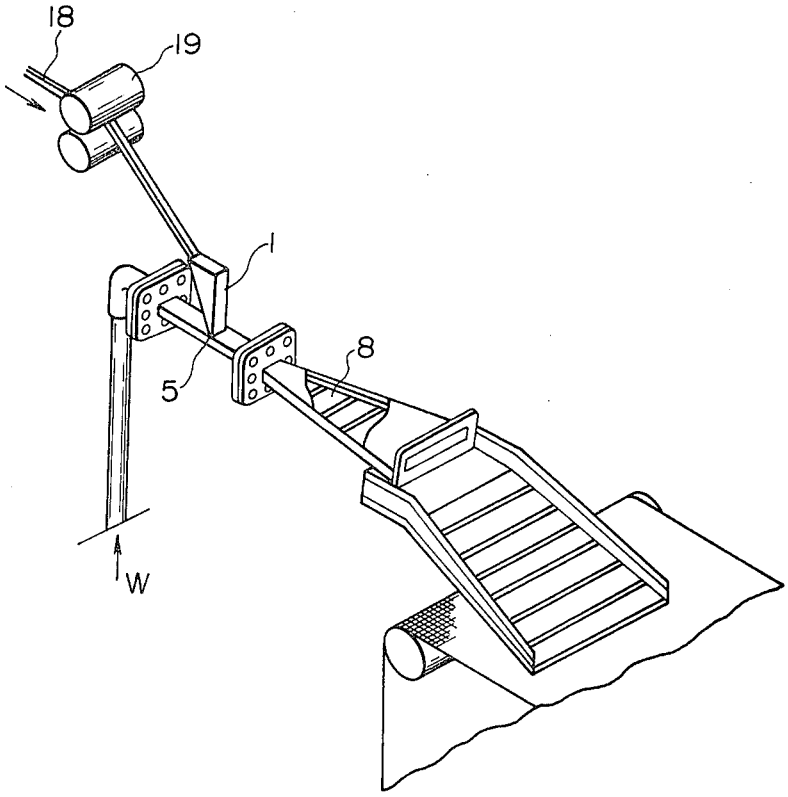
FIG. 1 is a perspective view of an apparatus for use in a conventional method.
Figure 2:
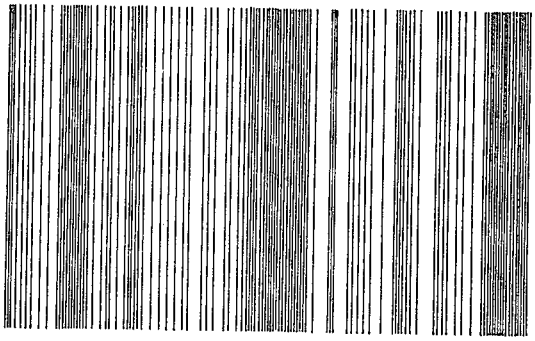
FIG. 2 is a plan view of the sheet-like material prepared using the apparatus of FIG. 1.
Figure 3:
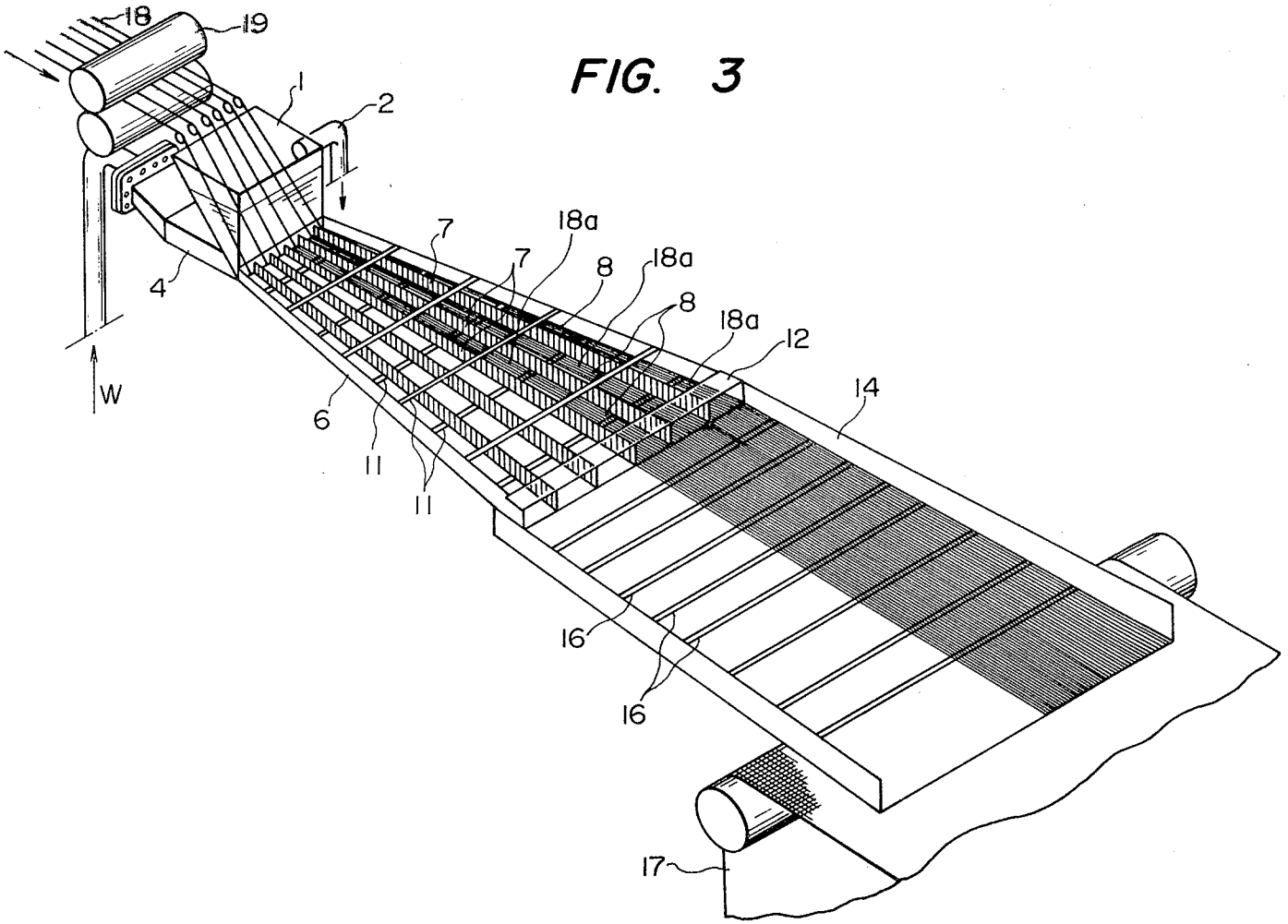
FIG. 3 is a perspective view of an apparatus according to the invention.
Figure 4:
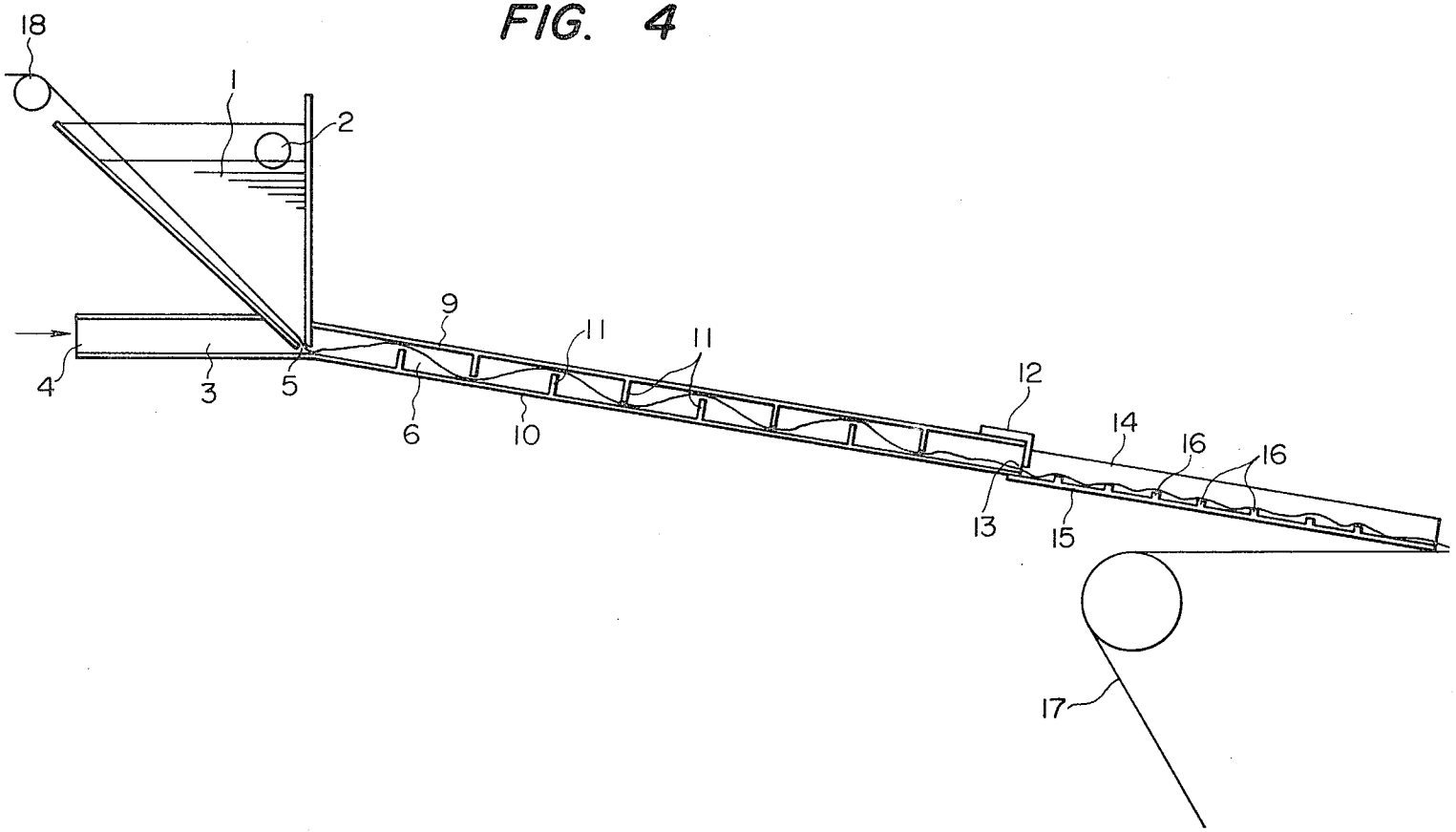
FIG. 4 is a side cross-sectional view of the apparatus of FIG. 3.

Referring to FIGS. 3 and 4, an overflow pipe 2 is provided at the upper portion of the side wall of a liquid tank 1. The liquid tank 1 is provided at the lower portion thereof with a liquid introduction tank 3 which is designed so that the width thereof gradually extends toward the bottom of the liquid tank 1. The liquid introduction tank 3 is provided with a liquid inlet 4 at one end thereof. A liquid outlet 5 in slit form is provided at the lower portion of the other end of the liquid introduction tank 3 and the lower portion of one side wall of the liquid tank 1 so that the liquid introduction tank 3 and the liquid tank 1 are connected to one another through the liquid outlet 5. The splitting unit 6 is an inclined, shallow, hollow rectangular member which is connected to the liquid outlet 5, and which is gradually increased in width toward the lower end thereof. The splitting unit 6 is divided by partition walls 7 into six inclined splitting grooves 8 which are also gradually increased in width toward the lower end of the groove. Each inclined splitting groove 8 is provided with a plurality of projections 11 at a top plate 9 and a bottom plate 10 thereof, alternatingly, at predetermined intervals, and in a direction perpendicular to the top plate 9 or the bottom plate 10. At the lower end of the splitting unit 6 is provided an end plate 12 which can be freely controlled in height, so as to form a slit-like opening 13 at the lower portion of the end plate. A subsequent inclined splitting unit 14 is connected to the inclined splitting unit 6 at the lower end thereof, and is provided with a plurality of projections 16 on a bottom plate 15 thereof at an angle perpendicular to the bottom plate 15. A bored conveyor 17 is provided in a manner such that is can rotate, while one end thereof is positioned so as to support the lower end of the subsequent inclined splitting unit 13.

A plurality of continuous fiber bundles 18 are introduced into the liquid tank 1 in which the liquid surface is maintained at a fixed level, at a fixed speed through a guide roller 21 by means of a pair of feed rollers 19. The liquid introduction tank 3 is charged with the liquid by introducing it through the liquid inlet 4 in predetermined amounts. The liquid increases its flow rate when it passes through the slit-like liquid outlet 5, and takes each continuous fiber bundle 18 in the liquid tank 1 into the corresponding inclined splitting groove 8. The continuous fiber bundle thus received into the groove 8 is split by the liquid flowing down the groove 8. The splitting is accelerated by changes in the flow rate caused by the projections 11 provided on the top plate 9 and bottom plate 10, and the thus split fibers flow down together with the liquid.

By controlling the flow rate of the liquid and the amount of the liquid discharged by means of the end plate 12 provided downstream in the subsequent inclined splitting unit 8, split fibers are arranged into a sheet-like material in the subsequent inclined splitting unit, which contains no partitions in the inside thereof, and the thus arranged sheet-like material flows down together with the liquid and is placed on the bored conveyor 17, which rotates at a fixed rate.

The liquid tank 1 is always filled with liquid. The air entrained between the continuous fiber bundles is discharged during the passage of the bundles through the liquid. As a result, the space between the bundles is filled with the liquid since this is responsible for fine splitting. It is desirable to keep the liquid surface in the liquid tank 1 at a fixed level. If the amount of the liquid entering the liquid tank 1 from the liquid introduction tank 3 is too large, the excessive liquid is discharged out of the liquid tank 1 through the overflow pipe 2. On the other hand, if the amount of liquid is too small, the liquid is supplemented from the outside. In this way, the liquid space can be maintained at a fixed level. In order for the liquid leaving the slit-like liquid outlet 5 to be uniformly introduced into each inclined splitting groove 8, it is required for the liquid introduction tank 3 to have a large volume and to be always filled with liquid.

Since the liquid is always uniformly introduced into each inclined splitting groove 8 and the diffusion of the liquid flowing down in the groove 8 is finely controlled, the splitting of the continuous fiber bundles 18 in the inclined splitting grooves 18 can be performed very uniformly, and the split width is also uniform.

Furthermore, since a plurality of projections 11 are provided at the top plate 9 and bottom plate 10 of each inclined splitting groove 8 in a direction perpendicular to the flow direction of the liquid, the continuous fiber bundle flows while moving up and down along with the liquid, as seen in FIG. 4. As a result, the continuous fiber bundle is repeatedly released and contracted according to changes in the flow rate of the liquid. Thus, greatly uniform splitting is achieved.

Furthermore, by controlling the amount of the liquid falling from the inclined splitting groove 8 by means of the split-like opening 13 formed by the end plate 12, the flow rate of the liquid can be adjusted, which permits control over the split width of the continuous fiber bundle 18.

Figure 5:
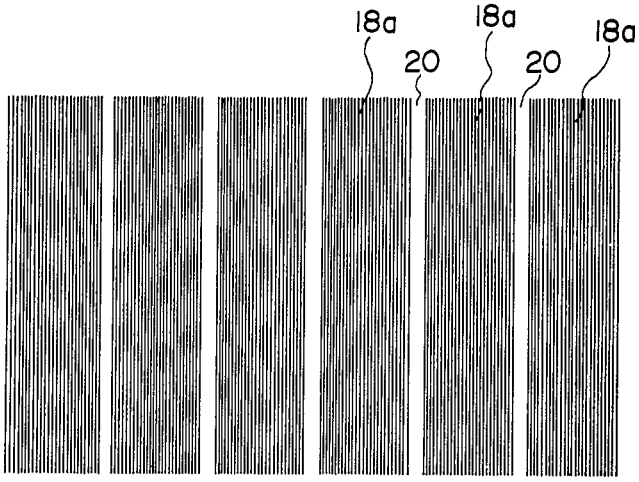
FIG. 5 is a plan view of the sheet-like material prepared using only the inclined splitting unit of the apparatus of FIGS. 3 or 4.

Therefore, depending on the split width required for each fiber bundle 18 to be introduced, the amount of the liquid passing through the split-like opening 13 may be controlled to an appropriate level. If the thus split fibers are placed directly on the bored conveyor 17 rotating with the liquid, there are clearances 20 between the sheet-like materials comprising the split fibers, as illustrated in FIG. 5, and there can only be obtained sheet-like materials in which there are clearances at fixed intervals in the width direction of the sheet-like material. This is caused by the fact that just after the split width is regulated in the inclined splitting groove 8, the split fibers are placed on the rotating bored conveyor 17.

Figure 6:
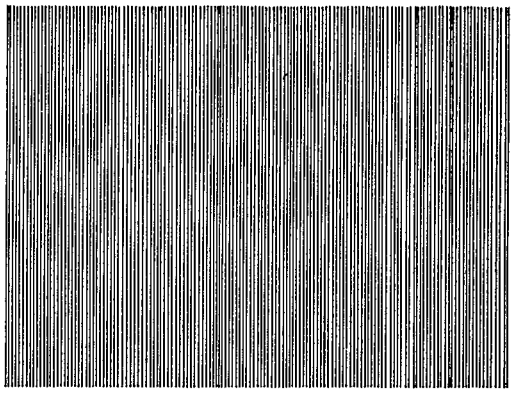
FIG. 6 is a plan view of the sheet-like material prepared using the apparatus of FIGS. 3 or 4.

In order to avoid the formation of such clearances in the sheet-like material, a subsequent inclined splitting unit 14 having no partitions in the width direction is provided just after the slit-like opening 13. The subsequent inclined splitting unit 14 is provided with a plurality of projections 16 on the bottom plate 15. The sheet-like material 18*a* comprising split fibers is generally subjected to further slight splitting when it passes over the projections 16. The thus prepared final sheet-like material is free from clearances, as illustrated in FIG. 6, and is uniform in the width direction.

If the continuous fiber bundle 18 is insufficiently split even by the use of a combination of the inclined splitting groove 8 and the subsequent inclined splitting unit 14, a steady twist, reversion, crossing, and so forth of partial agglomerates of monofilament groups constituting the continuous fiber bundle are mainly responsible for such insufficient splitting. In order to obtain a sheet-like material comprising more uniform split fibers, therefore, drawing or stretching may be applied, for example, by lengthening the period during which the fiber bundle stays in the liquid or by repeatedly changing the flow rate of the liquid.

Such drawing or stretching techniques for removing the twist, reversion, crossing, and so forth will hereinafter be explained.

Figure 7:
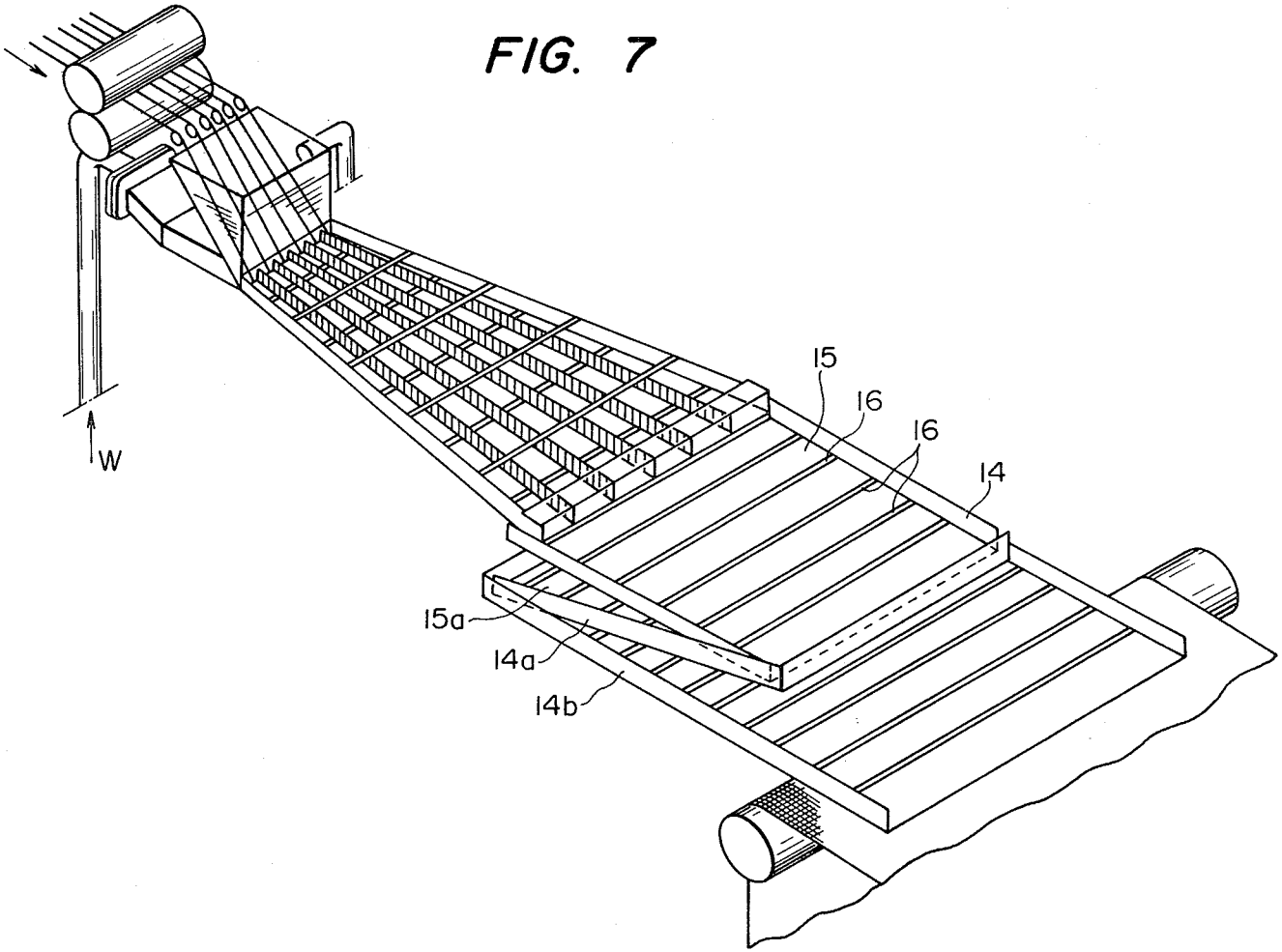
FIG. 7 is a perspective view of an apparatus according to the invention including a plurality of subsequent inclined splitting units.
Figure 8:
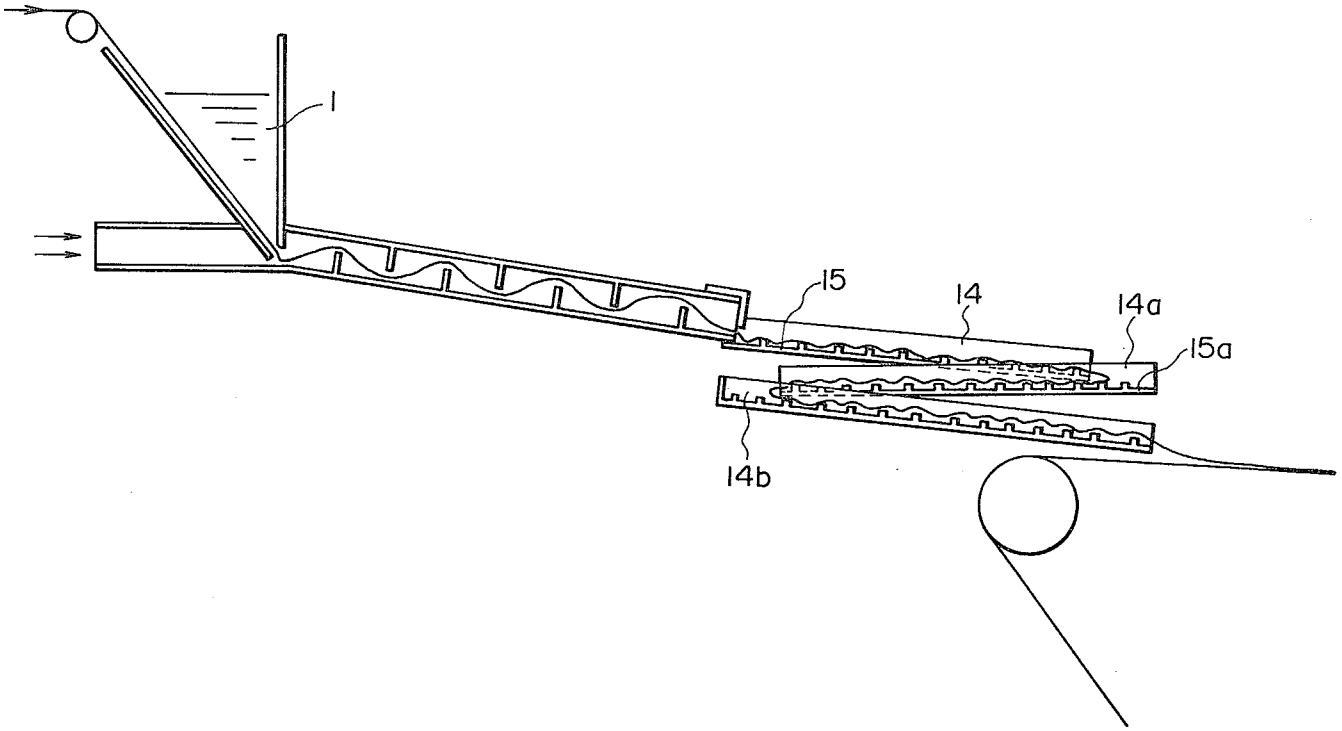
FIG. 8 is a side cross-sectional view of the apparatus of FIG. 7.

As illustrated in FIGS. 7 and 8, an inclined splitting frame 14*a* having the same shape as the inclined splitting unit 14 is attached to the lower end of the inclined splitting unit 14 in such a manner that there is a clearance of several milimeters between the bottom plate 15*a* of the inclined splitting frame 14*a* and the bottom plate 15 of the inclined splitting unit 14. The liquid containing the split fibers is turned in the opposite direction by transferring the liquid from the inclined splitting unit 14 to the inclined splitting frame 14*a*. Thus the split fibers are subjected to additional drawing or stretching at the lower end of the bottom plate 15 of the inclined splitting unit 14. The same effect as above can be obtained by providing an additional inclined splitting frame 14*b* in the same relative position as for the above splitting unit 14 and splitting frame 14*a*. The drawing or stretching effect can be more efficiently obtained by changing the inclination angles of the inclined splitting unit 14 and splitting frames 14*a* and 14*b*, thereby changing the flow rate of the liquid and changing the tension exerted on the fiber bundle.

Figure 9:
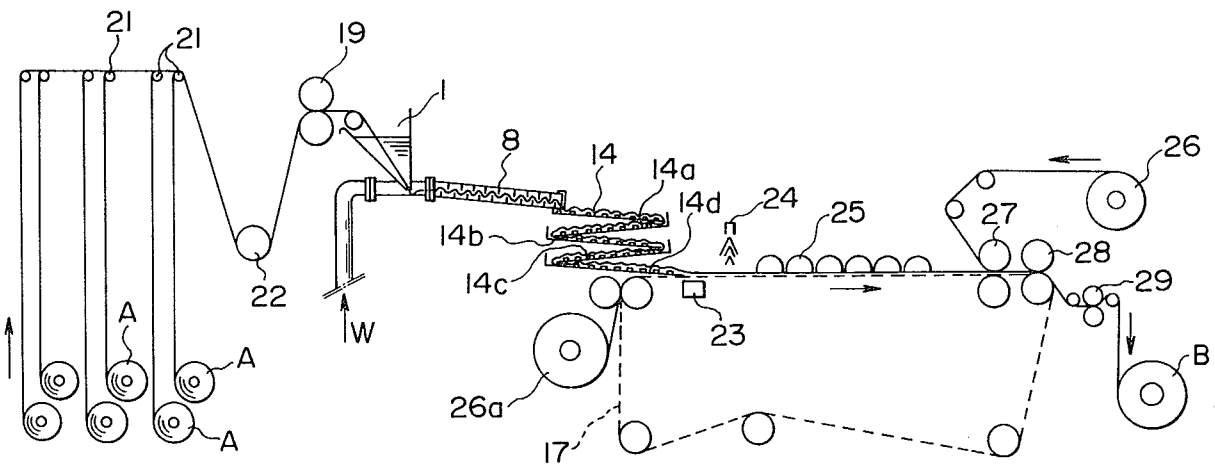
FIG. 9 is a side cross-sectional view of an apparatus for continuous production of a sheet-like material comprising split fibers according to the invention; and, FIGS. 10 and 11 are plan views of sheet-like materials prepared using the apparatuses of FIGS. 3 and 4, respectively, in which the rate of continuous fiber bundles being sent from a pair of feed rollers is higher than the rate of rotation of the bored conveyor.

FIG. 9 illustrates the continuous preparation of sheet-like materials according to the invention. A plurality of continuous fiber bundles are delivered from rolls A through guide rollers 21 to a dancer roller 22 where the tension is controlled, and thereafter are introduced into a liquid tank 1 at a fixed rate by means of a pair of feed rollers. Each fiber bundle is split in an inclined splitting groove 8 as described hereinbefore, and in subsequent inclined splitting units 14, 14*a*, 14*b*, 14*c*, and 14*d* as also described hereinbefore. The thus split fibers flow together with the liquid onto a rotating bored conveyor 17, while at the same time the liquid portion is suctioned through the conveyor 17 by a water-removing box 23 disposed so as to come into contact with the back surface of the conveyor 17. The water-removing box 23 is provided with fine slits on the top surface thereof in the width direction of the conveyor, which permit increased suctioning of the liquid by means of a vacuum pump (not shown).

On the sheet-like material of split fibers which has been mounted on the rotating bored conveyor 17 is sprayed a resin, to maintain the shape of the sheet, by means of a spray 24, which is then dryed by a heater. In this case, the type of the resin is appropriately chosen depending on the type of the continuous fiber bundle used. A substrate 26, of which one side has been coated with an adhesive and the other side with a releasing agent, is delivered in such a manner that the adhesive surface comes into contact with the sheet-like material. The substrate 26 is pressed to the material by means of pairs of nip rollers 27 and 28, through the bored conveyor 17. The thus combined material is passed through a slitter 29 where the edges are cut away, and is then wound on a roll B.

In the case of carbon fibers, when a substrate, one side of which has been coated with a thin epoxy-based resin layer, is brought into close contact with a sheet-like material of such split carbon fibers, if the upper roller of the nip roller 27 is a heating roller, the epoxy-based resin is softened from the back surface of the substrate, which ensures more steady adhesion, or, if the upper roller is cooled, hardening is accelerated, which leads to an increase in productivity.

The structure of the substrate 26 can be appropriately chosen depending on the type of the continuous fiber bundle or the application in which the sheet-like material is to be used. Depending on the type of the continuous fiber bundle there can be used a method in which the sheet-like material is adhered to the substrate 26 by means of nip rollers 27 and 28 by the utilization of the adhesiveness of the resin sprayed from the sprayer 24, and where thereafter, it is dried by the heater 25, slit by a slitter 29, and wound on the roll.

When tape fabrics having holes, unwoven fabrics or the like are used as a substrate, the substrate 26*a* may be introduced together with the rotating bored conveyor 17 between the conveyor 17 and the lower end of the last inclined splitting frame 14*d*, as shown in FIG. 9. In this case, the sheet-like material flows together with the liquid on the substrate 26*a*, and at the same time, the liquid is removed through the holes of the substrate and the bored conveyor 17 by means of the water-removing box 23. Thereafter, the thus combined material is sprayed with a resin by means of the spray 24, dried, and drawn by means of pairs of nip rollers 27 and 28.

As the liquid as used herein, it is usually preferred to use water at ordinary temperature. In addition, heated water and liquids containing various surface active agents to accelerate splitting into monofilaments can be used. Furthermore, various sizing agents and resinous agents having an adhesion effect maintaining the form of sheet may be added to the liquid.

Figure 10:
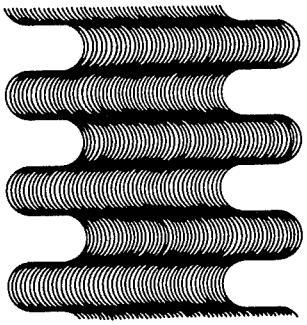
Figure 11:
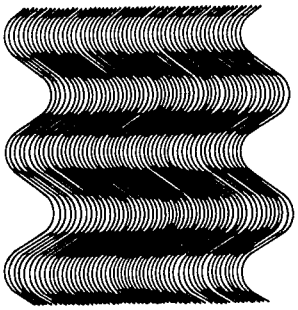

Thin sheets having various shapes can be prepared by the use of the method and apparatus of the invention. In the apparatus shown in FIG. 3, for example, when the feed rate of the feed roller 19 sending the continuous fiber bundles is made nearly equal to that of the bored conveyor 17, the split fibers are arranged in one direction and, therefore, there is obtained a sheet-like material in which the split fibers are arranged as illustrated in FIG. 6. When the rate of the feed roller 19 is made higher than that of the bored conveyor 17, the split fibers are arranged in a wave-like pattern as illustrated in FIGS. 10 or 11, and are mounted on the conveyor 17.

The use of the method and apparatus of the invention easily permits the preparation of a uniform sheet-like material using continuous fiber bundles, and thus is very useful in industry.

The method and apparatus of the invention can be more effectively applied to inorganic fibers such as carbon fibers, silicon carbide fibers, and aluminum fibers, which are hydrophilic fibers. In particular, the method and apparatus of the invention can be used to split continuous carbon fiber bundles without producing undesirable damage.

The following examples are given to illustrate the invention in greater detail.

EXAMPLE 1

Using the splitting unit shown in FIG. 3 and the process shown in FIG. 9, carbon fibers were split, under the conditions shown below, to prepare a sheet-like material.

(1) Carbon Fiber Tow: Six tows consisting of 10,000 filaments (2) Processing Conditions (a) Rate of Feed Roller: 10 m/min (b) Split Width of Tow: 50 m/m per tow (total 300 m/m)

(c) Liquid and its Amount: water at ordinary temperature 30 l/min (d) Load of Water-Removing Pump: $60\times10^{-2}$ mmHg (e) Bored Conveyor: 30 mesh (f) Rate of Rotation of Bored Conveyor: 9.99 m/min (g) Adhesion Resin: water-soluble vinyl acetate-based resin (h) Amount of Adhesion Resin: 5 g/m$^2$ (as solids)

(i) Heater Temperature: 120° C.

There was thus obtained a sheet-like material comprising split carbon fibers in which monofilaments were arranged in one direction, and the density was 15 g/m$^2$ and the average thickness was 0.08 mm.

EXAMPLE 2

The procedure of Example 1 was repeated except that there were used the following processing conditions:

(1) Carbon Fiber Tow: Six tows consisting of 10,000 filaments (2) Processing Conditions (a) Rate of Feed Roller: 10 m/min (b) Split Width of Tow: 50 m/m per tow (total 300 m/m)

(c) Liquid and its Amount: water at ordinary temperature, 30 l/min (d) Load of Water-Removing Pump: $6\times10^{-2}$ mmHg (e) Bored Conveyor: 30 mesh (f) Rate of Rotation of Bored Conveyor: 5.0 m/min (g) Adhesion Resin: water-soluble vinyl acetate-based resin (h) Amount of Adhesion Resin: 5 g/m$^2$ (i) Heater Temperature: 120° C.

There was obtained a sheet-like material comprising split carbon fibers and having a wave-like pattern in which the density was 30 g/m$^2$, the average thickness was 0.09 mm, and the angle between fibers was nearly 45°.

What is claimed is:

1. A process for producing a sheet-like material composed of split fibers, comprising:

introducing a plurality of continuous fiber bundles into a liquid contained in an inclined splitting unit which is gradually extended in width toward the lower end thereof, said unit being divided into a plurality of grooves so that each fiber bundle travels with the liquid flowing in the corresponding groove;

splitting each fiber bundle by the action of liquid flowing in the groove while gradually extending the flow width toward the lower end of the groove;

uniformly arranging the resulting split fibers in a subsequent inclined splitting frame; and continuously placing the thus arranged split fibers on a rotating conveyor to form the sheet-like material.

2. The process as claimed in claim 1, including providing at least one additional inclined splitting frame to cause the fibers to turn in direction at least one time.

3. The process as claimed in claim 1, wherein the flow rate of each fiber bundle is made nearly equal to the rate of rotation of the conveyor to prepare a sheet-like material in which the split fibers are arranged in one direction.

4. The process as claimed in claim 1, wherein the flow rate of the fiber bundle is made higher than the rate of rotation of the conveyor to prepare a sheet-like material in which the split fibers are arranged in a wave-like form.

5. An apparatus for the production of a sheet-like material composed of split fibers, comprising:

a liquid tank from which a plurality of continuous fiber bundles are to be fed, said tank having a slit-like flow outlet provided at a lower portion of a side wall thereof, said bundles passing from said tank together with the liquid;

an inclined splitting unit which is gradually widened toward the lower end thereof, said unit being divided into a plurality of inclined grooves gradually widening toward the lower end of the unit, and plates forming walls of the groove being provided with a plurality of projections in a direction perpendicular to the flow-direction of the liquid; and a subsequent inclined splitting unit which is gradually increased in width toward the lower end thereof, said unit being provided with a plurality of projections on a bottom plate thereof in a direction perpendicular to the flow direction of the liquid.

6. The apparatus as claimed in claim 5, including a plurality of inclined splitting frames connected oppositely to each other so as to cause a change in direction in the flow of said liquid.

7. The process as claimed in claims 1, 2 or 3, wherein the continuous fiber bundle is a continuous carbon fiber bundle.

8. The process as claimed in claim 2, including varying the flow rate among said inclined splitting frames to exert a stretching force on said fibers.

9. The process as claimed in claim 1, including undulating the flow in said grooves by providing projections perpendicular to the flow in said grooves.

10. The process as claimed in claim 1, including controlling the flow rate from the end of said grooves to control the split width of said bundle.

11. The apparatus as claimed in claim 5, the liquid level in said tank being maintained substantially constant, said tank being supplied from a source at a location proximate said slit-like outlet.

12. The apparatus as claimed in claim 5, including conveyor means located at an outlet of said splitting unit, and traveling at a speed proximate a flow rate of said bundle.

13. The apparatus as claimed in claim 5, including conveyor means located at an outlet of said splitting unit, and traveling at a speed lower than a flow rate of said bundle.

14. The apparatus as claimed in claims 12 or 13, including means separating a liquid fraction of said flow, and means for applying an adhesive binder to said sheet-like material.

15. The apparatus as claimed in claim 14, including heating means proximate said applying means, and means for applying a tape web to said sheet-like material.

16. The apparatus as claimed in claim 15, said tape web applying means being arranged proximate said splitting unit outlet, said web allowing the extraction of said liquid portion therethrough.

* * * * *